US007731562B2

(12) United States Patent
Huber

(10) Patent No.: US 7,731,562 B2
(45) Date of Patent: Jun. 8, 2010

(54) TOY HELICES HAVING VARIABLE RATES OF MOVEMENT

(76) Inventor: Virgil D. Huber, 5604 Oak Pl., Bethesda, MD (US) 20817

( * ) Notice: Subject to any disclaimer, the term of this patent is extended or adjusted under 35 U.S.C. 154(b) by 338 days.

(21) Appl. No.: 11/531,033

(22) Filed: Sep. 12, 2006

(65) Prior Publication Data

US 2008/0064297 A1 Mar. 13, 2008

(51) Int. Cl.
*A63H 33/00* (2006.01)
*F16F 1/06* (2006.01)

(52) U.S. Cl. ..... 446/486; 267/166; 267/180

(58) Field of Classification Search ..... 267/166, 267/180; 446/486
See application file for complete search history.

(56) References Cited

U.S. PATENT DOCUMENTS 231,150 A * 8/1880 Cliff ..... 267/286
1,932,000 A * 10/1933 Starkey ..... 192/107 T
2,250,042 A * 7/1941 Sundt et al. ..... 267/166.1
2,415,012 A 1/1947 James
2,643,109 A * 6/1953 Wood ..... 267/180
3,058,705 A * 10/1962 Hagg et al. ..... 248/624
3,292,884 A * 12/1966 Scheldorf ..... 248/560
3,727,902 A * 4/1973 Burckhardt et al. ..... 267/166.1
6,193,225 B1 * 2/2001 Watanabe ..... 267/180
6,944,899 B2 * 9/2005 Gladney ..... 5/716

* cited by examiner

*Primary Examiner*—John Ricci
(74) *Attorney, Agent, or Firm*—Baker & Daniels LLP

(57) ABSTRACT

Toy helices each having a variable rate of movement. The toy helices, such as springs and coils, for example, may be formed of at least two different types of material each having different properties such as elasticity, flexibility, and attraction. In one embodiment, a first portion of a toy helix may be constructed of a first material having a first elasticity and a second portion of a toy helix may be coupled to the first portion and constructed of a second material having a second elasticity. The first elasticity and second elasticity are not identical and, thus, have different restoring forces acting to return the toy helix to its original shape. After such a toy helix is stretched, for example, the helix has a variable rate of movement during return to the compressed state because the first portion returns to its original shape at a different rate than the second portion.

16 Claims, 4 Drawing Sheets

TOY HELICES HAVING VARIABLE RATES OF MOVEMENT

BACKGROUND

1. Field of the Invention

The present invention relates to toys. In particular, the present invention relates to toys in the form of helices, springs, and coils having variable rates of movement.

2. Description of the Related Art

A helix is generally a shape such as a spring or coil, for example. A helix may be mathematically defined as a space curve having parametric equations according to the following: $x=r\cos t$; $y=r\sin t$; $z=ct$ (where $0\leqq t<2\pi$; r is the radius of the helix; $2\pi c$ is a constant giving the vertical separation of the helix's loops).

Toy helices are well-known, such as a toy called a Slinky®, for example. Such toy helices are formed as a coil with material having a uniform thickness, width, and elasticity. When a toy helix is positioned to effect movement of the helix, for example, when descending from a first stair surface to a second stair surface, the toy helix generally moves, i.e., stretches and compresses, at a constant speed during movement. When moving from the first stair surface to the second stair surface, the toy helix stretches and compresses to walk down the stairs. Further, when a toy helix is stretched, the toy helix returns to an original, compressed shape at a generally constant rate of movement. The constant rate of movement results from the toy helices, such as springs and coils, typically being constructed from a single type of material having a uniform thickness, width, and elasticity. The elasticity of a material is generally the material property which causes the material to be restored to an initial or original shape after stretching or compression.

SUMMARY

The present invention provides toy helices each having a variable rate of movement. The toy helices, such as springs and coils, for example, may be formed of at least two different types of material each having different properties such as elasticity, flexibility, and attraction, such as magnetic properties, electrostatic properties, and adhesive properties, such as hook-and-loop type attraction. In one embodiment, a first portion of a toy helix may be constructed of a first material having a first elasticity and a second portion of a toy helix may be coupled to the first portion and constructed of a second material having a second elasticity. The first elasticity and second elasticity are not identical and, thus, have different restoring forces acting to return the toy helix to its original shape. Thus, if the first elasticity has a restoring force greater than the restoring force of the second elasticity, then the first portion will move at a faster rate than the second portion, and vice versa, to return to the original shape. After such a toy helix is stretched, for example, the helix has a variable rate of movement during return to the compressed state because the first portion returns to its original shape at a different rate than the second portion.

Advantageously, the devices described herein provide toy helices, such as springs and coils, for example, having variable rates of movement. Further, an exemplary helix as described herein is a toy which moves at differing rates while returning to an original state.

In one form thereof, the present invention provides a toy helix including a plurality of turns, the toy helix including a first helical portion having a first attraction force between adjacent turns within the first helical portion; and a second helical portion coupled to the first helical portion, the second helical portion having a second attraction force between adjacent turns within the second helical portion; wherein the first helical portion is capable of moving at a different rate than the second helical portion.

In another form thereof, the present invention provides a toy helix including a plurality of turns, the helix including a first end portion; a middle portion connected to the first end portion; a second end portion connected to the middle portion; the first end portion and the second end portion having a first attraction force between adjacent turns within each first end portion and second end portion; and the middle portion having a second attraction force between adjacent turns within middle portion; wherein the first attraction force causes the first end portion and the second end portion to move at a first rate; wherein the second attraction force causes the middle portion to move at a second rate different than the first rate.

In yet another form thereof, the present invention provides a spring toy including a first portion having a first elasticity; a second portion coupled to the first portion, the second portion having a second elasticity different than the first elasticity; the spring toy movable between a compressed state and a stretched state; wherein upon movement of the spring toy from the stretched state to the compressed state, the first portion moves at a different rate than the second portion.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate several exemplary embodiments, and such exemplifications are not to be construed as limiting the scope of the invention in any manner.

DETAILED DESCRIPTION

Figure 1:
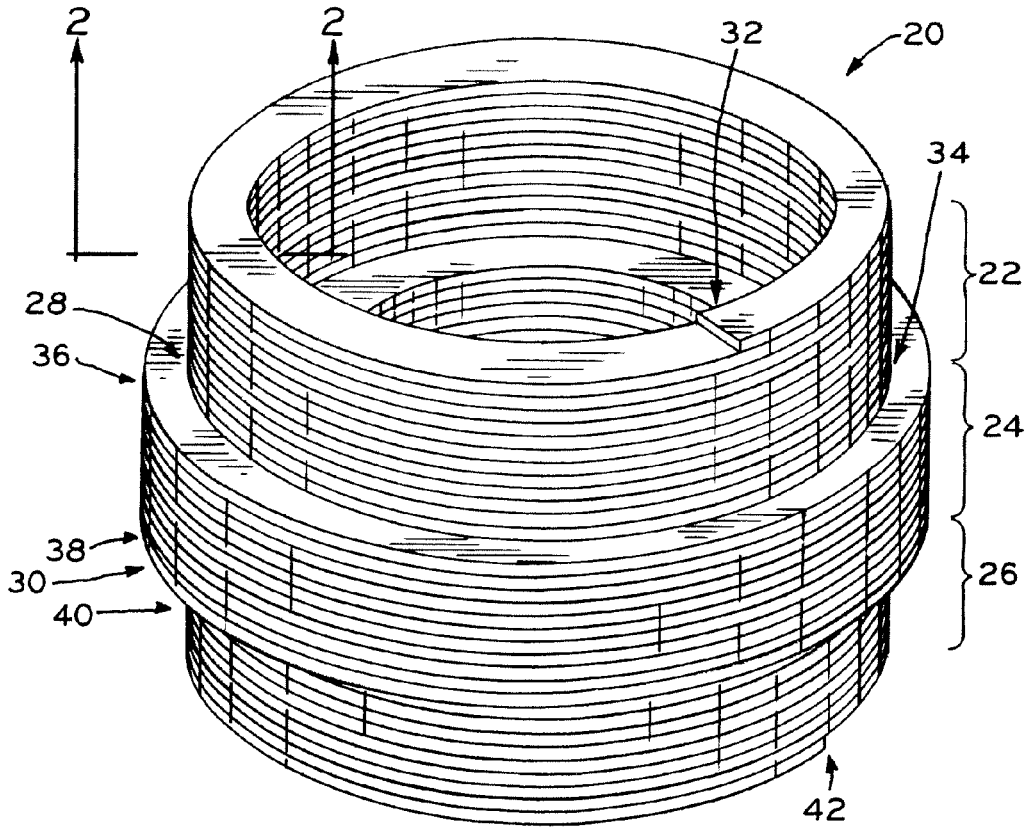
FIG. 1 is a perspective view of an exemplary toy helix of the present invention, showing the helix in a vertical, compressed or stacked state.

Referring to FIG. 1, toy helix, spring, or coil 20 includes a plurality of turns of material and is shown in a first, original, compressed or stacked state, i.e., helix 20 is shown in FIG. 1 with no external forces acting on it. Helix 20 may include first helical portion or end portion 22, second helical portion or middle portion 24, and third helical portion or end portion 26. Each of portions 22, 24, and 26 include a portion of the plurality of turns in helix 20. First helical portion 22 includes first end 32 and second end 34. Second helical portion 24 includes first end 36 and second end 38. Third helical portion 26 includes first end 40 and second end 42. In an exemplary embodiment, each of first portion 22, second portion 24, and third portion 26 are formed of materials having uniform elasticity and attraction, In an alternative embodiment, each of first portion 22, second portion 24, and third portion 26 are formed of materials having non-uniform elasticity and attraction.

Figure 6:
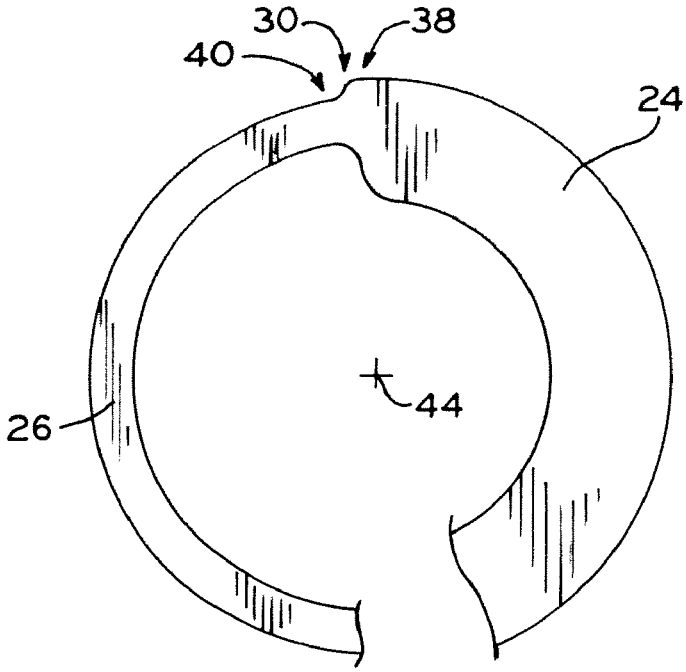
FIG. 6 is a cross-sectional view of a portion of the helix of FIG. 4, taken along line 6-6 of FIG. 4.
Figure 7:
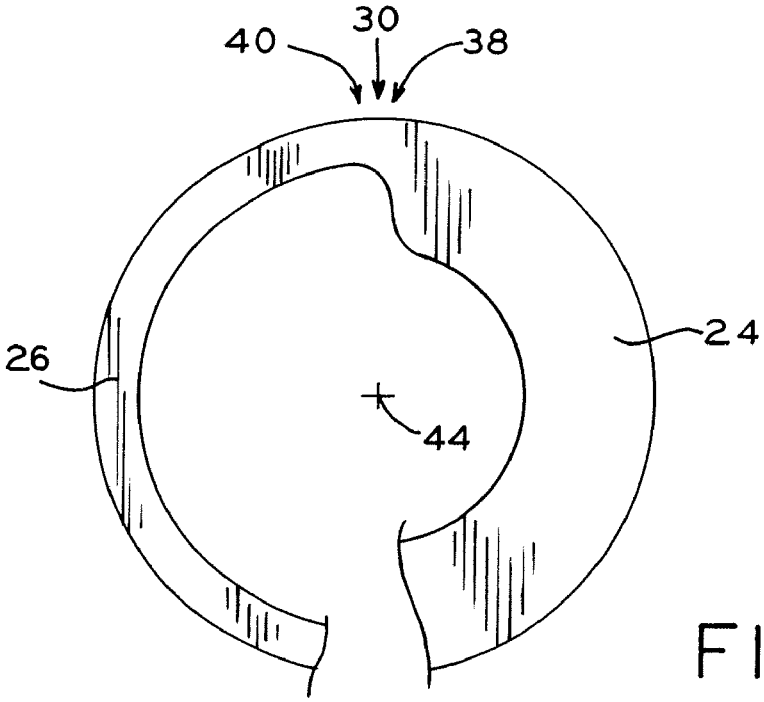
FIG. 7 is a cross-sectional view of a portion of an alternative embodiment of the helix of FIG. 4.

As shown in FIGS. 1 and 6, second end 38 of second helical portion 24 is coupled with first end 40 of third helical portion 26 at interface 30. Interface 30 may be formed as any suitable coupling of second helical portion 24 and third helical portion 26, for example, an adhesive bond, by tape, by glue, a magnetic coupling, by a hook and loop fastener, a welded coupling, by a fastener, or by integral formation. Similarly, second end 34 of first helical portion 22 is coupled with first end 36 of second helical portion 24 at interface 28, which is substantially similar to interface 30 as described above. As shown in FIG. 6, interface 30 may couple ends 38 and 40 such that the outer diameter of second portion 24 is greater than the outer diameter of third portion 26. Alternatively, as shown in FIG. 7, interface 30 may couple ends 38 and 40 such that the outer diameter of helix 20 is a continuous and smooth transition from second portion 24 to third portion 26, i.e., the outer diameter of second portion 24 is substantially equivalent to the outer diameter of third portion 26.

Figure 4:
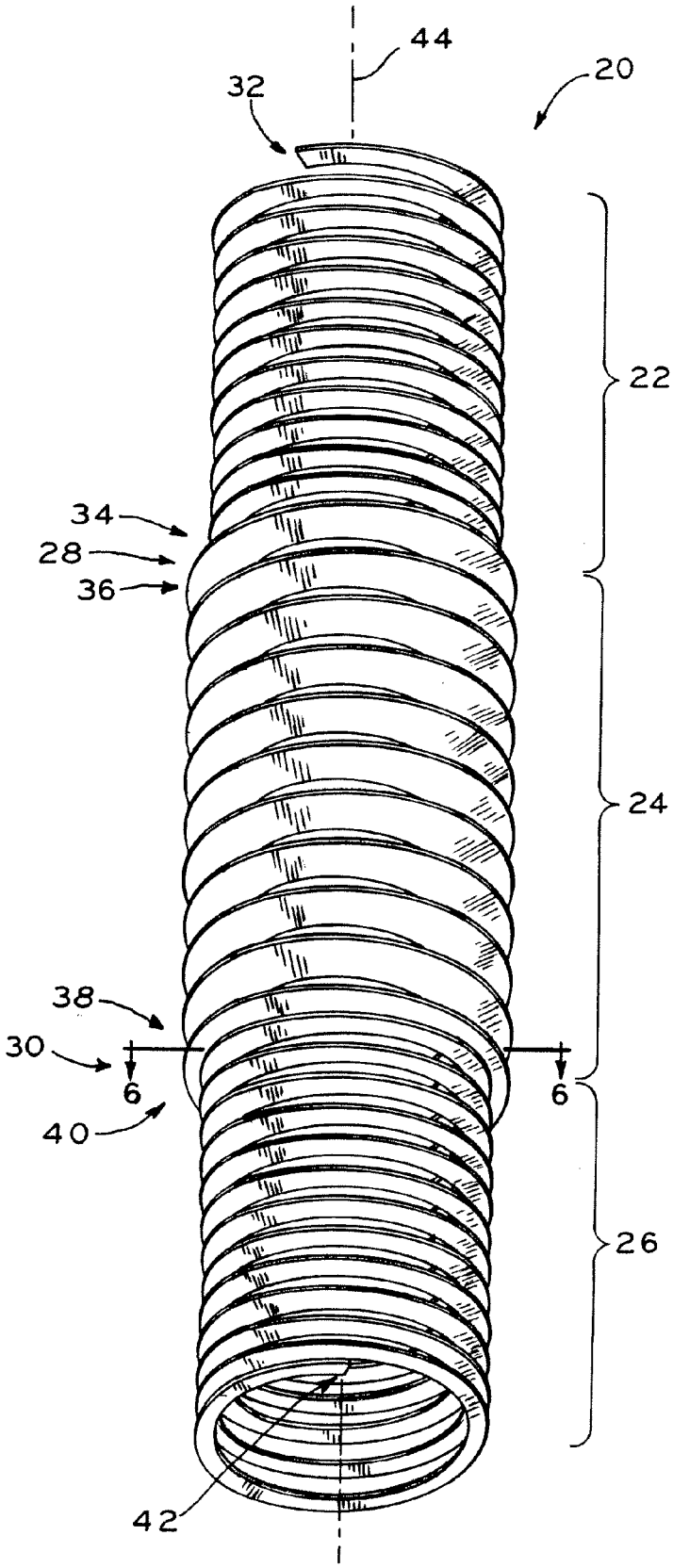
FIG. 4 is a perspective view of the helix of FIG. 1, showing the helix in a stretched state.

Referring now to FIG. 4, toy helix 20 is shown in a second, stretched state, i.e., helix 20 is shown in FIG. 4 with an external force stretching helix 20. When such force is removed, helix 20 returns to the original, compressed state (FIG. 1). Alternatively, the second state may be that shown in FIG. 1 and described above, wherein, when external forces are removed, the helix expands to return to its original state such as that shown in FIG. 4, i.e., the first, original state is a stretched state and the second state is a compressed state.

In an exemplary embodiment, helix 20 includes first helical portion 22 and second helical portion 24 formed of different materials. The materials may be selected from metals, spring steel, metal alloys, wood, polymers, plastics, such as polypropylene, polyethylene, and PVC, for example, paper, rubber, latex, fluids, liquids, and any other suitable material as well as any combination of the foregoing. The materials which form portions 22 and 24 have properties including flexibility, elasticity, and attraction. The materials which form portions 22 and 24 may also have a property including viscoelasticity. When helix 20 moves from the stretched state (FIG. 4) to the original, compressed state (FIG. 1), the rate at which portions 22 and 24 return to the original state depend on the elasticity, flexibility, and mutual attractiveness, e.g., properties such as magnetic, electrostatic, or hook-and-loop-type forces acting to attract adjacent turns of the helix or coil toward one another, of the material. The rate is essentially a rate of speed, i.e., a ratio between distance and time, at which portions 22 and 24 move, e.g., compress or stretch, in a direction substantially along longitudinal axis 44 of helix 20. In an exemplary embodiment, the flexibility, elasticity, and attraction properties of portions 22 and 24 are not identical. Rather, first portion 22 has a first degree of elasticity, flexibility, or attraction, and second portion 24 has a second degree of elasticity, flexibility, or attraction. As the degree of elasticity or attraction increases, the material returns to the original state at a faster rate because of increased restoring forces in the material.

Figure 3:
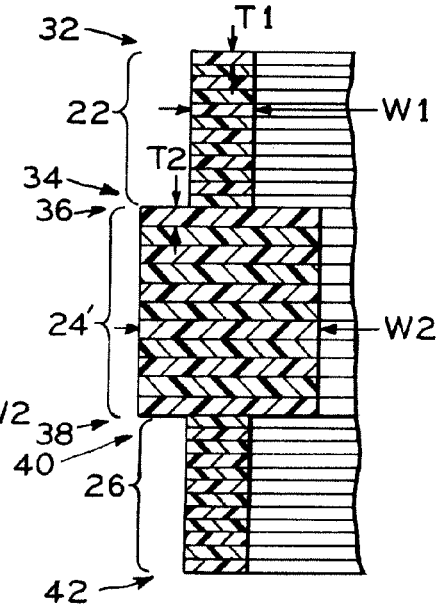
FIG. 3 is a cross-sectional view of a portion of an alternative embodiment toy helix of the present invention.

In an alternative embodiment shown in FIG. 3, first helical portion 22 and second helical portion 24' are formed of identical material, thus having the same material properties of flexibility, elasticity, and attraction. Portions 22 and 24', however, are formed with different thicknesses in a dimension taken along a direction substantially parallel with longitudinal axis 44 of helix 20. As shown in FIG. 3, when first thickness T1 and second thickness T2 are different, different restoring forces are produced in first portion 22 and second portion 24' resulting from stretching of helix 20, thereby causing helix 20 to move with a variable rate because portion 22 moves at a rate different than portion 24'.

Figure 2:
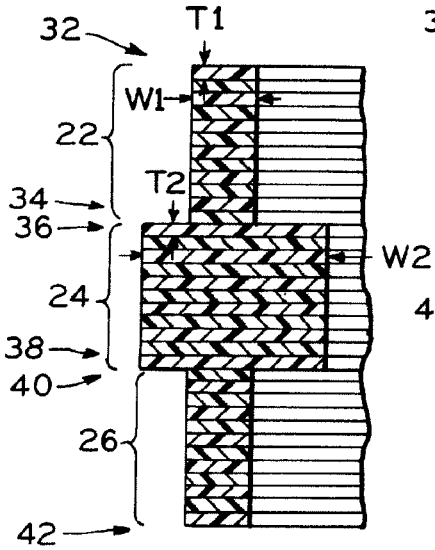
FIG. 2 is a cross-sectional view of a portion of the helix of FIG. 1, taken along line 2-2 of FIG. 1.

In yet another alternative embodiment, first helical portion 22 and second helical portion 24 are formed of identical material, but are formed with different widths in a dimension taken along a direction substantially perpendicular to longitudinal axis 44 of helix 20. As shown in FIGS. 2 and 3, when first width W1 and second width W2 are different, different restoring forces are produced in first portion 22 and second portion 24 when helix 20 is stretched, thus causing first portion 22 and second portion 24 to move at different rates when returning to their original, compressed states.

In a still further alternative embodiment, first helical portion 22 and second helical portion 24 are formed of different materials with differing widths and/or thicknesses, thereby further causing first portion 22 and second portion 24 to move at different rates when returning to their original states.

In one embodiment, helix 20 also includes third helical portion 26 formed of any of the materials described above with respect to first portion 22 and second portion 24. Third portion 26 may be formed with identical material having the same width and thickness of first portion 22 or second portion 24, as described above, such that third portion 26 has identical elasticity, flexibility, and attraction properties as first portion 22 or second portion 24, respectively. In an exemplary embodiment, third portion 26 is formed of identical material having the same size thickness, width, and shape as first portion 22. Alternatively, third portion 26 may be formed of a different material than portions 22 and 24 such that portion 26 has different elasticity, flexibility, and attraction properties relative to first portion 22 and second portion 24; therefore, helix 20 has three different rates of movement when moving from the stretched state (FIG. 4) to the original, compressed state (FIG. 1). In the embodiment shown in FIGS. 1, 2, 4, and 5, third portion 26 is formed of the same material having identical thickness and width as first portion 22, such that helix 20 has a variable rate of movement because first portion 22 and third portion 26 move at a first rate different than a second rate at which second portion 24 moves.

In another embodiment, third portion 26 may be formed with identical material as either first portion 22 or second portion 24, but has a width and/or a thickness which is different than first portion 22 and/or second portion 24, respectively, thereby causing helix 20 to move at three different rates of movement.

Figure 5:
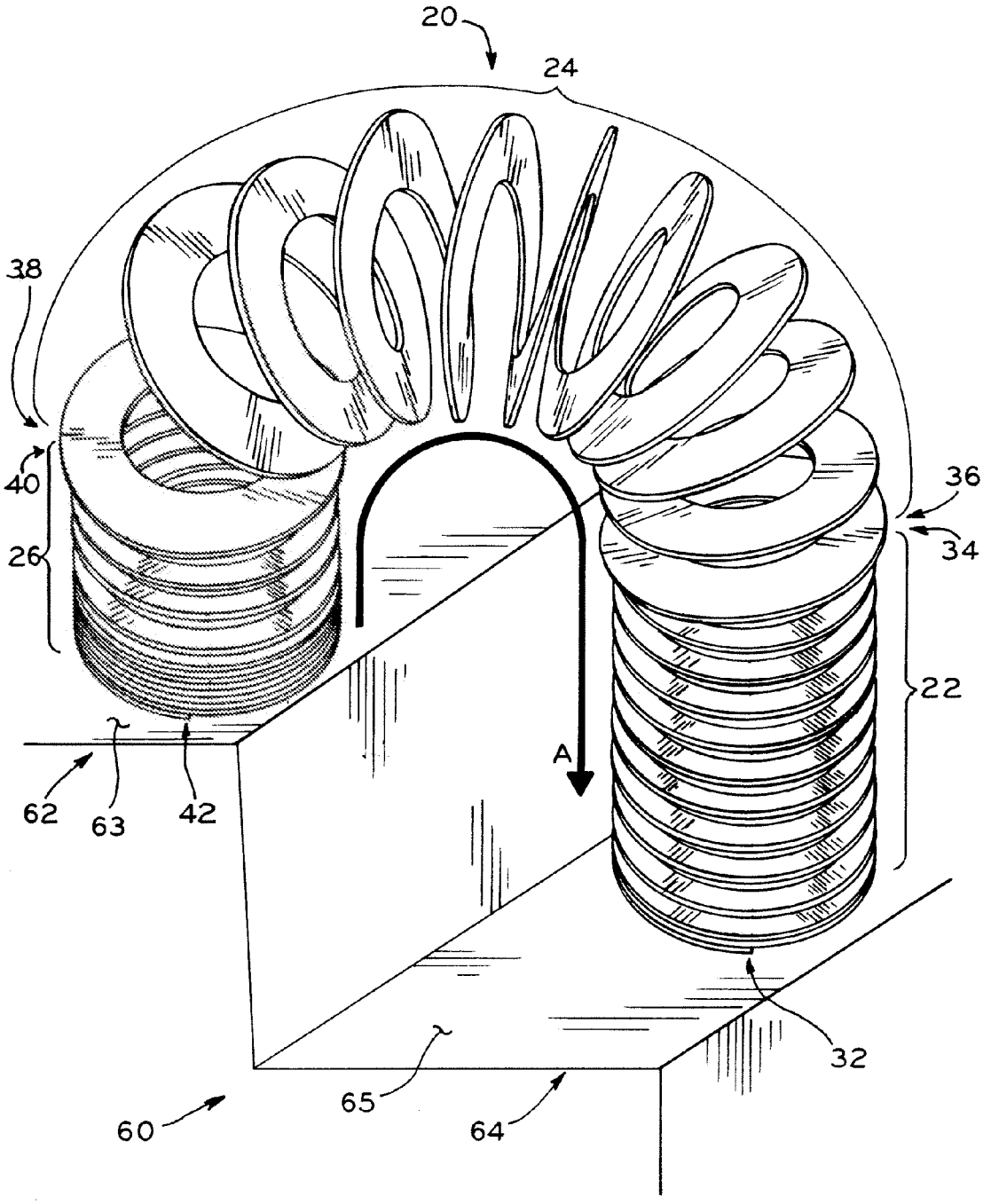
FIG. 5 is a perspective view of the helix of FIG. 1, showing the helix moving from a first surface to a second surface.

Referring now to FIG. 5, an exemplary use of helix 20 is shown. Helix 20 is positioned on staircase 60 including first stair 62 and second stair 64. Helix 20 starts in a vertical position on first surface 63 of first stair 62. An external force, such as a push by hand, moves end 32 toward the general direction of second stair 64 until end 32 abuts second surface 65. First portion 22 stretches along path A until end 32 abuts second surface 65. The coupling between first portion 22 and second portion 24 causes second portion 24 to stretch and follow first portion 22 in the general direction of path A. Similarly, the coupling between second portion 24 and third portion 26 causes third portion 26 to stretch and follow second portion 24 in the general direction of path A. First portion 22 begins to compress and return to its original, compressed shape once end 32 abuts second surface 65. Once first portion 22 is fully compressed, second portion 24 compresses and, upon full compression of second portion 24, third portion 26 compresses. Once helix 20 is fully compressed, the momentum of helix 20 forces second end 42 of third portion 26 to move toward the next step (not shown) located below second surface 65 of second stair 64, after which toy helix 20 continues to walk down staircase 60 while moving at a variable rate of movement.

During movement, first portion 22 moves at a first rate in the general direction of path A. Second portion 24 moves at a second rate in the general direction of path A. In the embodiment of FIGS. 1, 2, 4, and 5, third portion 26 moves at the first rate in the general direction of path A. Thus, as helix 20 traverses from first stair 62 to second stair 64, the rate at which helix 20 moves is variable because first portion 22 and third portion 26 move, i.e., compress, at a first rate and second portion 24 moves, i.e., compresses, at a second rate different than the first rate. Advantageously, such variable rate of movement of helix 20 provides a fun and interesting toy.

The following non-limiting Example illustrates various features and characteristics of the present invention which are associated with helices having variable rates of movement and which are not to be construed as limited thereto.

EXAMPLE

To form an exemplary helix according to the present invention, multiple ring structures are cut from a flexible material, such as various plastics or rubber, having an approximate thickness of 2 mm. Each ring has an outside diameter of approximately 95 mm and an inside diameter of approximately 60 mm. Each ring is cut to form a nearly-closed letter "C". Each ring is then joined to another ring, thereby forming a two-turn helix. The rings are joined together via adhesive or tape, for example. Cut rings are joined together until a ten-turn helix is formed. To effectively double the thickness of rings, a second ring substantially similar to the first ring may be placed on each of the rings throughout the ten-turn helical structure. Ten turns are then cut from a plastic helix having different elastic properties and flexibility relative to the flexible material of the rings, and attached to one end of the flexible material helix. Thirteen turns are then cut from a plastic helix having different elastic properties and flexibility relative to the flexible material of the rings, and attached to the other end of the flexible material helix. The result is a helical structure having variable rates of movement because of the different elastic properties and flexibility of the materials.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A spring toy comprising:

a first portion having a first elasticity and including a plurality of first turns made of a first material;

a second portion coupled to said first portion, said second portion having a second elasticity different than said first elasticity, said second portion including a plurality of second turns made of a second material different from said first material;

said plurality of first turns of said first portion and said plurality of second turns of said second portion each normally disposed in contact with one another;

the spring toy movable between a compressed state and a stretched state;

wherein upon movement of the spring toy from said stretched state to said compressed state, said first portion moves at a different rate than said second portion.

2. The spring toy of claim 1, further comprising a third portion coupled to at least one of said first portion and said second portion, said third portion having one of said first elasticity and said second elasticity.

3. The spring toy of claim 1, further comprising a third portion coupled to at least one of said first portion and said second portion, said third portion having a third elasticity different than said first elasticity and said second elasticity.

4. The spring toy of claim 1, wherein said first portion has a first thickness and said second portion has a second thickness, said first thickness different than said second thickness.

5. The spring toy of claim 4, further comprising a third portion coupled to at least one of said first portion and said second portion, wherein said third portion has a third thickness different than said first thickness and said second thickness.

6. The spring toy of claim 1, wherein said first portion has a first width and said second portion has a second width, said first width different than said second width.

7. The spring toy of claim 6, further comprising a third portion coupled to at least one of said first portion and said second portion, wherein said third portion has a third width different than said first width and said second width.

8. The spring toy of claim 1, wherein said plurality of first turns of said first portion and said plurality of second turns of said second portion have rectangular cross-sections.

9. A toy helix including a plurality of turns, the toy helix comprising:

a first helical portion having a first attraction force between adjacent turns of said first helical portion, said adjacent turns of said first helical portion each having a first cross-sectional width; and a second helical portion coupled to said first helical portion, said second helical portion having a second attraction force different than said first attraction force between adjacent turns of said second helical portion, said adjacent turns of said second helical portion each having a second cross-sectional width different from said first cross-sectional width;

respective adjacent turns of said first helical portion and respective adjacent turns of said second helical portion each normally disposed in contact with one another; and said turns of said first helical portion and said turns of said second helical portion respectfully made of first and second different materials;

wherein said first helical portion is capable of moving at a different rate than said second helical portion.

10. The toy helix of claim 9, wherein said first attraction force and said second attraction force comprise one of a magnetic force, an electrostatic force, and an elastic force.

11. The toy helix of claim 9, further comprising a third helical portion coupled to said second helical portion, said third helical portion having said first attraction force between adjacent turns of said third helical portion, said adjacent turns of said third helical portion each having said first cross-sectional width.

12. The toy helix of claim 9, wherein said turns of said first and second helical portions helical portions have rectangular cross-sections.

13. A toy helix including a plurality of turns, the toy helix comprising:

a first helical portion having a plurality of adjacent first turns made of a first material, said plurality of adjacent first turns each having at least one of a first width and a first thickness;

a second helical portion having a plurality of adjacent second turns made of a second material, said plurality of adjacent second turns each having at least one of a second width and a second thickness, said at least one first width and first thickness being different than said at least one second width and second thickness;

said plurality of adjacent first turns and said plurality of adjacent second turns each having an attraction force therebetween, whereby said plurality of adjacent first turns and said plurality of adjacent second turns are each normally disposed in contact with one another;

whereby said first helical portion has a first attraction force between said plurality of adjacent first turns and said second helical portion has a second attraction force between said plurality of adjacent second turns, and said first helical portion thereby moves at a different rate than said second helical portion.

14. The toy helix of claim 13, wherein said first attraction force and said second attraction force comprise one of a magnetic force, an electrostatic force, and an elastic force.

15. The toy helix of claim 13, wherein said first helical portion has a plurality of adjacent first turns with a first width and said second helical portion has a plurality of adjacent second turns having a second width different than said first width.

16. The toy helix of claim 13, wherein said first helical portion has a plurality of adjacent first turns with a first thickness and said second helical portion has a plurality of adjacent second turns with a second thickness different than said first thickness.

* * * * *